US005911783A

United States Patent [19]

Wiener et al.

[11] Patent Number: 5,911,783

[45] Date of Patent: Jun. 15, 1999

[54] ADJUSTING DEVICE FOR THE ROLLS OF A CALENDAR

[75] Inventors: Stefan Wiener; Hans Simmon, both of Hanover, Germany

[73] Assignee: Hermann Berstorff Maschinenbau GmbH, Hanover, Germany

[21] Appl. No.: 08/876,391

[22] Filed: Jun. 16, 1997

[30] Foreign Application Priority Data

Jun. 14, 1996 [DE] Germany ..... 196 23 700

[51] Int. Cl.[6] ..... B21B 37/07; B21B 31/32

[52] U.S. Cl. ..... 72/245

[58] Field of Search ..... 72/237, 238, 239, 72/240, 245, 248; 91/167 R; 92/23, 27, 28, 15

[56] References Cited

U.S. PATENT DOCUMENTS 3,596,490 8/1971 Willeke et al. ..... 72/245
3,853,368 12/1974 Eichelsheim ..... 92/DIG. 4
4,471,686 9/1984 Garlapaty ..... 92/27

FOREIGN PATENT DOCUMENTS 24 42 710 9/1974 Germany .

*Primary Examiner*—Joseph J. Hail, III
*Assistant Examiner*—Rodney Butler
*Attorney, Agent, or Firm*—Foley & Lardner

[57] ABSTRACT

An adjusting device for the rolls of a calender having a hydraulic drive for the fine setting of the rolls in their working position and a hydraulic drive for positioning the rolls in the working, maintenance and roll-change positions. The hydraulic drive for positioning the rolls includes hydraulic cylinders having double-acting pistons. An interlock device is provided, by which the piston rod can be interlocked positively in the working position of the rolls, after which the piston rod can be acted on by a prestressing force opposed to the adjusting direction in such a way that the interlock has no play.

10 Claims, 4 Drawing Sheets

ADJUSTING DEVICE FOR THE ROLLS OF A CALENDAR

BACKGROUND OF THE INVENTION

The invention relates to an adjusting device for the rolls of a calendar having a hydraulic drive for the fine setting of the rolls in their working position, and a drive for positioning the rolls in the working, maintenance and roll-change positions.

Adjusting devices of the general type described are already known. In one such device, the drive for positioning the rolls in the working, maintenance and roll-change positions is carried out by means of a spindle drive. An adjusting device of this type is described, for example, in the German Published Specification 24 42 710. However, spindle drives have the disadvantage that, in comparison to hydraulic drives, they are technically complicated and expensive. In addition, the adjustment speed is comparatively low. On the other hand, however, hydraulic drives have the disadvantage that because of the compressibility of the hydraulic fluid, in particular in the case of hydraulic systems with relatively large adjustment paths, inadequate rigidity of the adjusting device frequently results.

SUMMARY OF THE INVENTION

The invention is based on the object of avoiding the noted disadvantages by providing an adjusting device which is distinguished by its simple structure, high adjusting speeds, and by a high rigidity, which enables precise settings of the roll gaps.

According to the invention, this object is achieved by providing an adjusting device having a hydraulic drive for the fine setting of the rolls in their working position, a drive for positioning the rolls in the working, maintenance and roll-change positions, with the drive for positioning the rolls being constructed as a hydraulic drive with hydraulic cylinders having double-acting pistons, and an interlock device. By means of the interlock device, the piston rod can be interlocked positively in the working position of the rolls, and the piston rod, after being interlocked, can be acted on by a prestressing force opposed to the adjusting direction in such a way that the interlock has no play.

The adjusting device described results in completely eliminating the influence of the compressible hydraulic fluid in the hydraulic cylinder on the accuracy of the setting of the roll gap. The piston rod of the hydraulic cylinder is fixed by the interlock device, with the prestressing force opposed to the adjusting direction eliminating any play so that a precise roll gap is ensured even before the entry of the material.

Preferably, the piston of the piston rod can, after being interlocked, have pressure applied to it in order to apply the prestressing force opposed to the adjusting direction. A solution of this type is distinguished by a high functional reliability and low technical complexity.

According to a preferred embodiment, a stop is provided for the piston of the drive for positioning the rolls in the working position. This stop ensures that the piston rod is already correctly positioned in the working position before any actuation of the interlock device.

Within the framework of the invention, the interlock device for the working position of the rolls preferably is formed by a bolt engaging in a groove in the piston rod. A construction of this type is distinguished by its simple structure and, because of the positive engagement under all conditions, ensured interlocking.

It is advantageous if the interlock device is arranged on the piston rod close to the roll. The length of that section of the piston rod which is acted on by the roll forces in the working position can thus be kept very small, so that elasticity in the piston rod continues to have no influence on the precision of the roll gap.

In a further refinement of the invention, a second interlock device is provided in such a way that the drive for positioning the rolls can also be interlocked positively in the maintenance position and in the roll-change position. Since, particularly in the rubber industry, contamination always has to be taken into account, a clamping interlocking of the drive in its maintenance and roll-change positions would be too unreliable.

Preferably, the second interlock device is arranged on a rear piston rod of the hydraulic drive for positioning the rolls. A construction of this type is advantageous due to reduced space requirements. In addition, the second interlock device is preferably formed by two grooves arranged in the rear piston rod and two bolts engaging alternately in these grooves. A construction of this type enables the overall length to be shortened.

BRIEF DESCRIPTION OF THE DRAWINGS

Exemplary embodiments of the invention will be described in more detail below, and are illustrated in the application drawings in which.

DETAILED DESCRIPTION OF THE PREFERRED EMBODIMENTS

Figure 1:
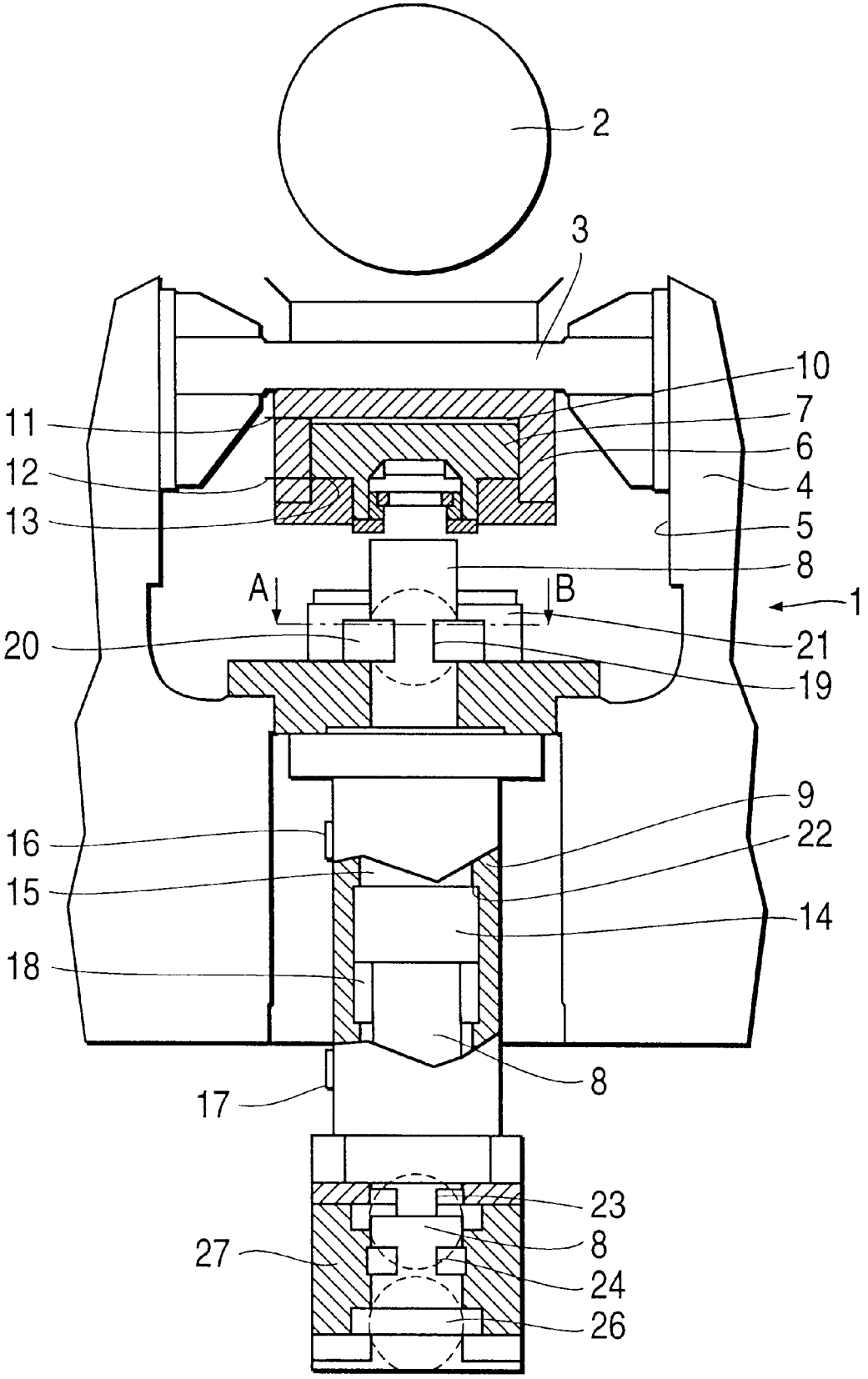
FIG. 1 shows an adjusting device, illustrated partly in longitudinal section, in the working position.

In the application drawings, an adjusting device for a roll 2 of a calendar is generally designated by 1. The roll 2 is arranged in a bearing 3 which can be displaced in the vertical direction in a calendar frame 4 on sliding surfaces 5.

Arranged on the underside of the bearing 3 is a hydraulic drive for the fine setting of the roll 2, said drive being formed by a piston 7 arranged in a cylinder 6. The piston 7 is supported on a piston rod 8 of a hydraulic cylinder 9 of a drive for positioning the roll 2. Located above the piston 7 is a space 10 which is filled with hydraulic fluid and which can be acted on via a connection 11. A space 13 underneath the piston 7 can be acted on via a connection 12.

The piston rod 8 has a piston 14 which is arranged inside the hydraulic cylinder 9. A space 15 above the piston 14 can be acted on by hydraulic fluid via a connection 16. A space 18 underneath the piston 14 can be acted on via a connection 17. Of course, although it cannot be seen from the drawings, cylinder 6 and hydraulic cylinder 9 are arranged on both sides in the region of the bearings 3 for the roll 2.

Above the hydraulic cylinder 9, the piston rod 8 is provided with a groove 19. A bolt 20 of an interlock device 21 can engage positively in the groove 19. The bolt 20 can be actuated by means of a hydraulic cylinder 28. Provided in the hydraulic cylinder 9 is an upper stop 22 for the piston 14.

At its lower end, the piston rod 8 is provided with two grooves 23 and 24. Two bolts 25 and 26 of a second interlock device 27 can engage positively in the grooves 23 and 24.

Figure 4:
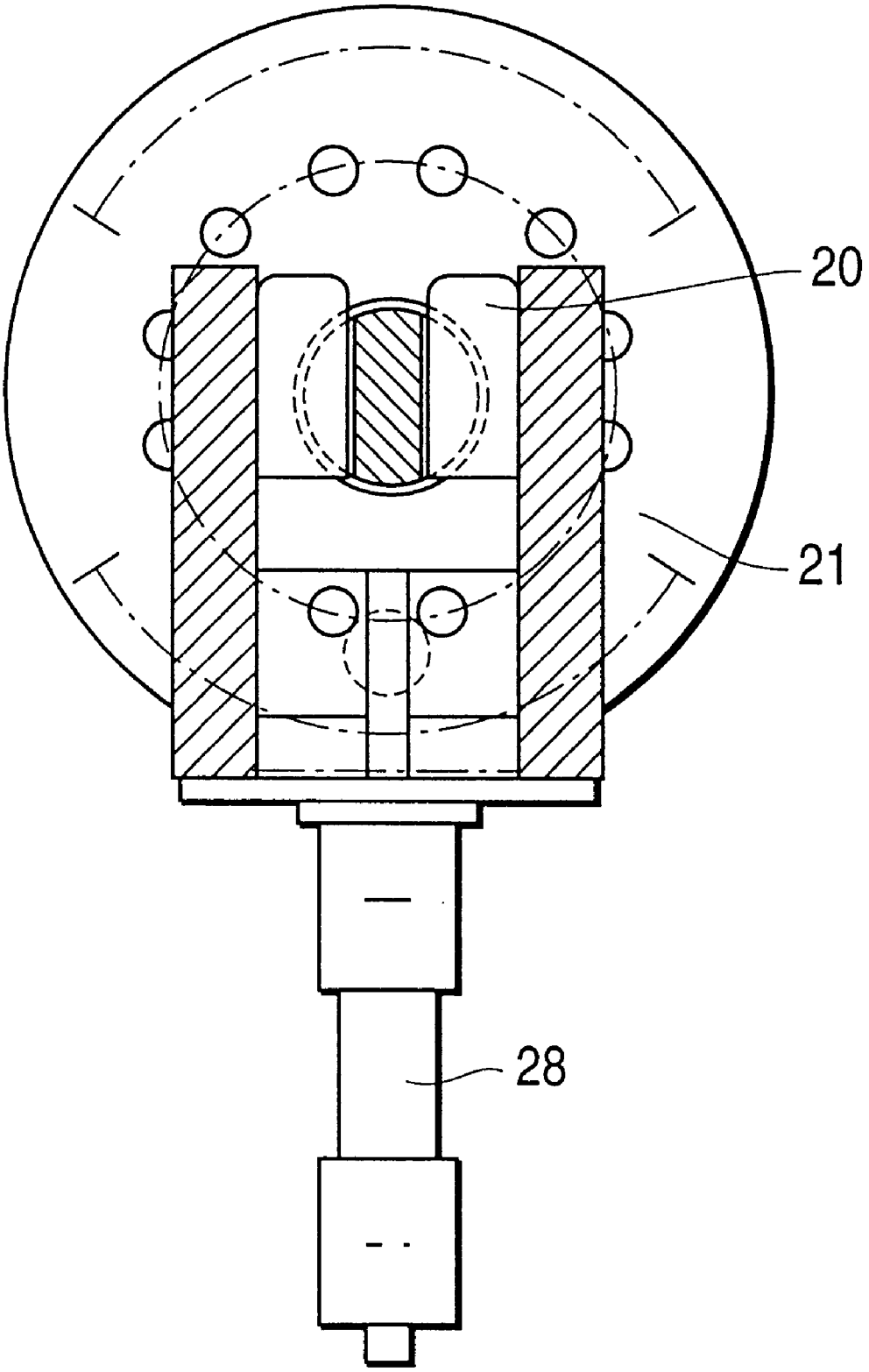
FIG. 4 shows the interlock device of the adjusting device in cross section.

FIG. 1 illustrates the working position of the roll 2 of the calendar. In such position, the bolt 20 of the interlock device 21 engages in the groove 19 of the piston rod 8. The piston rod 8 is in its upper end position, into which it is moved by applying pressure to the space 18 underneath its piston 14. When it has reached the working position of the roll 2, the piston 14 runs against a stop 22 of the hydraulic cylinder 9. The position of the stop 22 also positions the groove 19 of the piston rod 8 so that the bolt 20 of the interlock device 21 can then enter the groove without difficulty. The bolt 20 is moved by means of the hydraulic cylinder 28 (FIG. 4). Instead of the interlocking function being provided by the groove 19 of the piston rod 8, the interlocking can also be performed above the piston rod 8, for example in recesses formed in the region of the cylinders 6.

After interlocking has been carried out by means of the bolt 20, the space 15 above the piston 14 of the hydraulic cylinder 9 is additionally pressurized, so that a prestressing force is applied, and any play is removed from the interlocking already carried out. This has the effect that a precise roll gap is ensured even before the entry of the material. In addition, because of the interlocking, any influence of the compressible hydraulic fluid in the cylinder 9 is eliminated. This results in an overall high rigidity of the positioning. Instead of hydraulically pressurizing the piston 14, the prestressing force can also be produced, for example, by pressing a wedge into the interlock of the piston rod 8.

After the interlocking of the working position of the roll 2 has been carried out in the manner described, a fine setting of the roll gap is carried out by means of selective application of hydraulic fluid to the connections 11 or 12 of the cylinder 6. However, since there is in each case only a small quantity of hydraulic fluid in the spaces 10 and 13 of the cylinder 6, which is constructed as a short stroke cylinder, the influence of the compressibility is negligible. What is important is that, according to the invention, the influence of the large fluid column in the hydraulic cylinder 9 is completely eliminated. However, at the same time it is possible to make use of all the advantages of a hydraulic drive.

Figure 2:
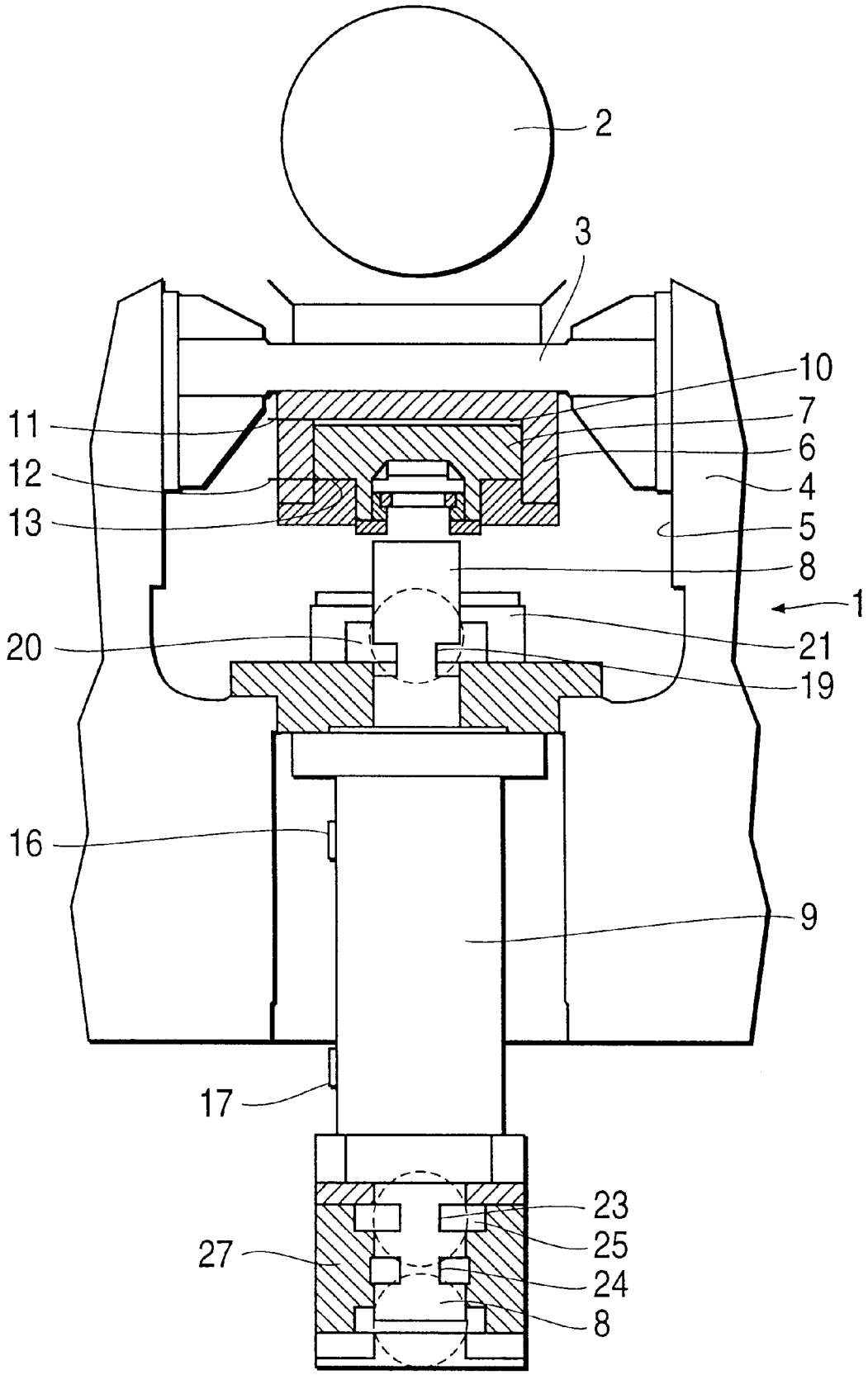
FIG. 2 shows the adjusting device according to FIG. 1 in its maintenance position.

If maintenance work is necessary on the calender, then the upper side of the piston 14 is relieved of load, that is to say the pressure in the space 15 is dissipated and the pressure is built up in the space 18. The interlock device 21 can then be actuated in such a way that the bolt 20 moves outwardly of the groove 19 of the piston rod 8 thereby releasing the rod. By means of pressurizing the space 15 above the piston 14, the piston rod 8 is moved downward, until the maintenance position illustrated in FIG. 2 is reached. In this maintenance position, the bolt 25 of the second interlock device 27 engages in the groove 23 in the lower half of the piston rod 8. By this means, the maintenance position is positively secured, so that the maintenance work can be carried out without any hazard.

Figure 3:
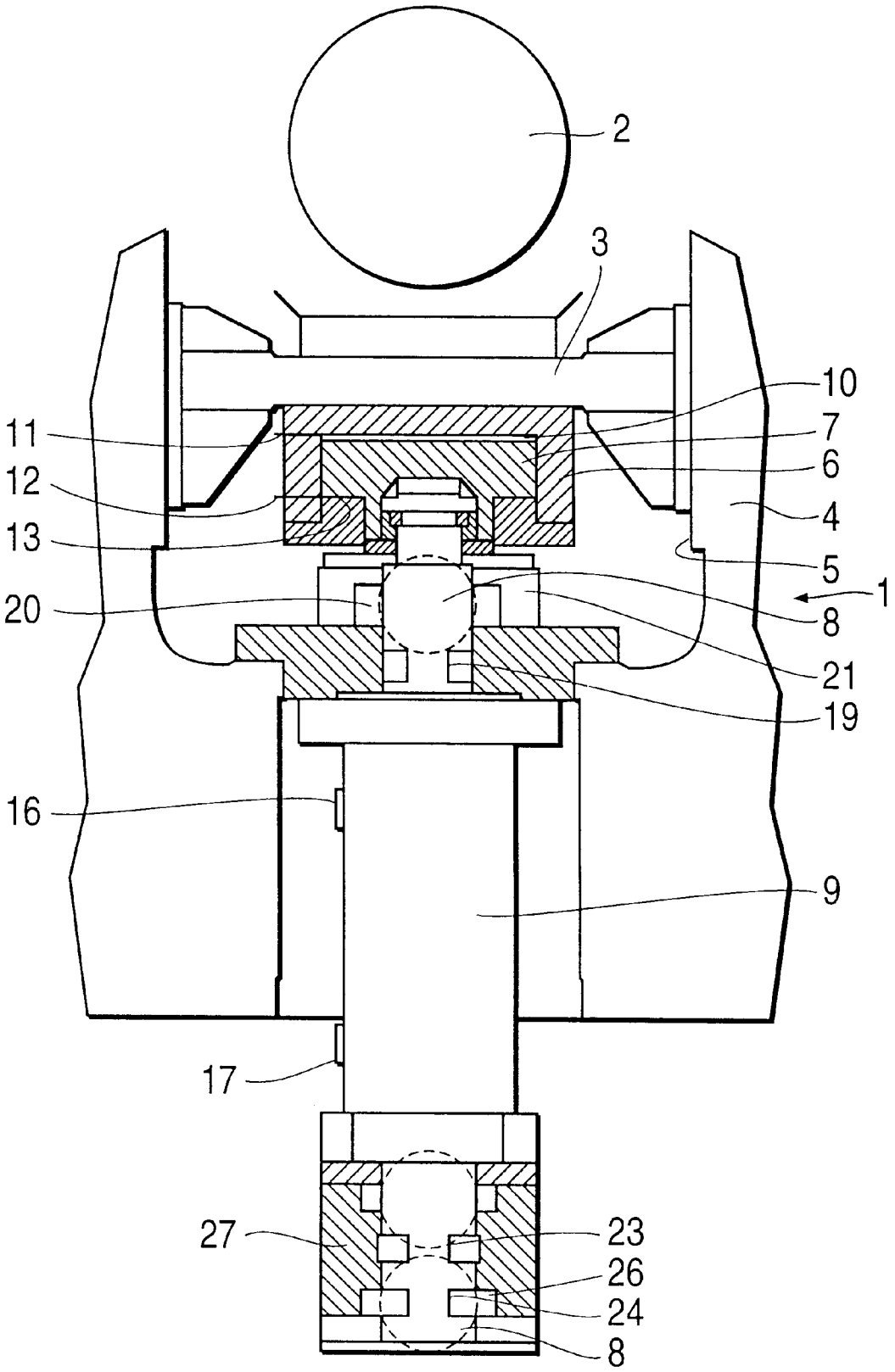
FIG. 3 shows the adjusting device according to FIG. 1 in its roll-change position.

If it is necessary to change the roll 2, then the second interlock device 27 is actuated in such a way that the bolt 25 emerges from the groove 23 and releases the piston rod 8. Via the connection 16, hydraulic fluid is fed to the space 15 above the piston 14 of the piston rod 8, so that the piston rod 8 is displaced downward into the roll-change position of the adjusting device 1, as illustrated in FIG. 3. When the roll-change position is reached, the second interlock device 27 is actuated in such a way that the bolt 26 enters the groove 24 of the piston rod 8 and locks the latter positively. A change of the roll 2 is now possible without difficulty.

In principle, as a result of the hydraulic actuation of the positioning of the roll 2, very rapid setting of the required positions is achieved. By this means, it is possible to shorten maintenance or replacement times in an advantageous manner.

The positive interlocking of the various positions of the adjusting device 1 by the interlock devices 21 and 27 secures the settings in an optimum way. Overall, the drive for positioning the roll 2 is also distinguished by construction which, in comparison with conventional solutions, is distinctly simplified and cost-effective.

After carrying out a roll change, all that is necessary to set the maintenance or working position is merely to perform the described settings in the reverse sequence.

What is claimed is:

1. An adjusting device for rolls of a calendar having a hydraulic drive for fine setting of the rolls in working position, comprising:

a separate hydraulic drive for positioning the rolls in working, maintenance and roll-change positions, the separate hydraulic drive having a hydraulic cylinder with a double-acting piston carried on a piston rod, an interlock device for positively interlocking with the piston rod in a position so as to maintain the rolls in the working position, and means for applying a prestressing force to at least one of the piston rod and the double-acting piston after the interlock device is interlocked with the piston rod so that play is removed from the interlocked interlock device and piston rod.

2. The adjusting device as claimed in claim 1, wherein the hydraulic cylinder is formed with a stop for the double-acting piston for properly positioning the rolls in the working position.

3. The adjusting device as claimed in claim 1, wherein the interlock device for the working position of the rolls is formed by a bolt engaging in a groove formed in the piston rod.

4. The adjusting device as claimed in claim 1, further comprising a second interlock device constructed and arranged for positively interlocking with the piston rod in a second position so as to maintain the rolls in the maintenance position and in a third position so as to maintain the rolls in the roll-change position.

5. The adjusting device as claimed in claim 1, wherein the means for applying a prestressing force includes a hydraulic mechanism for applying hydraulic pressure to the double-acting piston.

6. The adjusting device as claimed in claim 1, wherein the means for applying a prestressing force includes a wedge for pressing between the interlock device and the piston rod.

7. The adjusting device as claimed in claim 1, further comprising means for fine setting a roll gap.

8. The adjusting device as claimed in claim 3, wherein the interlock device is mounted on the piston rod relatively adjacent the roll.

9. The adjusting device as claimed in claim 4, wherein the second interlock device is arranged on a lower portion of the piston rod of the separate hydraulic drive for positioning the rolls.

10. The adjusting device as claimed in claim 9, wherein the second interlock device comprises two grooves arranged in the lower portion of the piston rod, and two bolts engaging alternately in these grooves.

* * * * *